US008336710B2

(12) United States Patent
Chang

(10) Patent No.: US 8,336,710 B2
(45) Date of Patent: Dec. 25, 2012

(54) SAFETY DRILL BIT SUSPENSION STRUCTURE

(76) Inventor: Chi-Tsai Chang, Taichung (TW)

( * ) Notice: Subject to any disclaimer, the term of this patent is extended or adjusted under 35 U.S.C. 154(b) by 140 days.

(21) Appl. No.: 13/050,929

(22) Filed: Mar. 17, 2011

(65) Prior Publication Data

US 2012/0031789 A1 Feb. 9, 2012

(30) Foreign Application Priority Data

Aug. 9, 2010 (TW) ..... 99215219 U

(51) Int. Cl.
*B65D 85/20* (2006.01)
*B65D 73/00* (2006.01)

(52) U.S. Cl. ..... 206/379; 206/806; 206/349

(58) Field of Classification Search ..... 206/806, 206/349, 379, 495, 1.5, 376, 807, 478, 477; 248/689; 211/70.6
See application file for complete search history.

(56) References Cited

U.S. PATENT DOCUMENTS 3,978,984 A * 9/1976 Cowley ..... 206/379
5,484,056 A * 1/1996 Wood ..... 206/349
5,979,649 A * 11/1999 Rosler ..... 206/379
5,979,652 A * 11/1999 Rosler ..... 206/481
6,425,482 B1 * 7/2002 Chiang ..... 206/349
6,637,591 B2 * 10/2003 Chen ..... 206/349
6,719,154 B2 * 4/2004 Kao ..... 211/70.6
6,834,767 B1 * 12/2004 Lin ..... 211/70.6
6,840,389 B2 * 1/2005 Chen ..... 211/70.6
7,175,151 B2 * 2/2007 Chang ..... 248/689
7,392,902 B2 * 7/2008 Chang ..... 206/349
7,416,082 B2 * 8/2008 Roesler ..... 206/379
7,624,865 B2 * 12/2009 Pendergraph et al. ..... 206/379
D620,349 S * 7/2010 Frommeyer et al. ..... D9/415
2005/0067307 A1 * 3/2005 Kao ..... 206/349
2007/0138043 A1 * 6/2007 Roesler ..... 206/379
2012/0091074 A1 * 4/2012 Chang ..... 211/4

* cited by examiner

*Primary Examiner* — Steven A. Reynolds
(74) *Attorney, Agent, or Firm* — Leong C. Lei

(57) ABSTRACT

A safety drill bit suspension structure is provided for safe suspension and exhibition of a drill bit and includes a suspension board and a carrier seat pivoted thereto. The carrier seat includes a semi-tubular base and a cover connected thereto at a bottom so that the cover can be turned over to cover and close the base to collectively form a tubular structure of carrier seat. The base forms therein a positioning ring for positioning of an inserted tool. The cover forms in a central portion thereof a resiliently deflectable retention tab, whereby when a drill bit is inserted into the carrier seat, a positioning cavity formed in a surface of the drill bit may receive the positioning cavity to resilient engage therewith for retaining. To remove the drill bit, a connection element that fixes the cover is cut off to allow the drill bit to be removed.

7 Claims, 5 Drawing Sheets

SAFETY DRILL BIT SUSPENSION STRUCTURE

TECHNICAL FIELD OF THE INVENTION

The present invention generally relates to a safety drill bit suspension structure, which comprises a suspension board and a lower carrier seat that are arranged to be in pivotal connection with each other to facilitate collapse of the suspension board and reduction of package volume, wherein the carrier seat comprises a base and a cover, which are mateable halves, having internally arranged resilient retention tab and an externally connected connection element so that a drill bit, after being inserted, may be firmly and securely retained in position to achieve security and theft resistance for suspended exhibition and whereby after releasing of the connection made by the connection element, the suspension structure may use the resilient deflection of the retention tab to facilitate removal and re-insertion of the drill bit so that the suspension structure provides an advantage of repeated use for suspension.

DESCRIPTION OF THE PRIOR ART

In general sale of tools, the tools are often set in a suspended condition to facilitate visual inspection and selection of a user. However, for a drill bit, which is often a slender object having a sharp spiral cutting edge, it is generally hard to realize a package for suspended exhibition. To overcome such an inconvenience of exhibition of drill bit for sale, a common solution is to collectively pack one or a number of different-size drill bits in a clear package box, and the package is suspended for exhibition of the drill bits. Such a package arrangement requires quite an amount of space due to the slender configuration of the drill bit and an additional extension in length caused by a suspension board. The package cost is thus increased. In addition, the drill bits packed inside the clear package box prevents the consumers from directly inspecting the drill bits. Further, for small sizes of drill bits, a large number of drill bits are packed together and this often leads to a waste in purchasing the drill bit. As such, these may hinder the purchase of the drill bit. However, the conventional package of a cardboard with a hollow shell attached thereto has long not been replaced by other arrangements of package and it is desired to provide a drill bit suspension structure that allows for truly easy suspended exhibition of drill bit and at the same time realizes theft resistance and repeated suspension of the drill bit.

SUMMARY OF THE INVENTION

In view of the problem of the existing way of suspended exhibition of drill bit in respect of theft resistance and inconvenience of inspection and selection, the present invention aims to provide a safety drill bit suspension structure, which comprises a suspension board and carrier seat that are connected in a pivotal faun and the carrier seat comprises a cover that forms therein a resilient retention tab and is provided with a connection element for connection and fixation, so that secured package of suspended exhibition of drill bit can be realized to improve the current problems of being not theft resistant for suspension of the drill bit.

A primary objective of the present invention is that a suspension board and a carrier seat are connected in a pivotal form to allow easy collapse of the suspension board for reduction of package volume. The carrier seat comprises a cover that forms a resilient retention tab so as to reliably secure and retain a drill bit in suspended exhibition and achieve the purposes of security and theft resistance. To remove a suspended tool, a connection element is cut off and the resiliency of the retention tab allows the tool to be removed for use and to be re-suspended, thereby realizing security for suspended package and exhibition of drill bit and also achieving additional purposes of repeated suspension of the tool.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
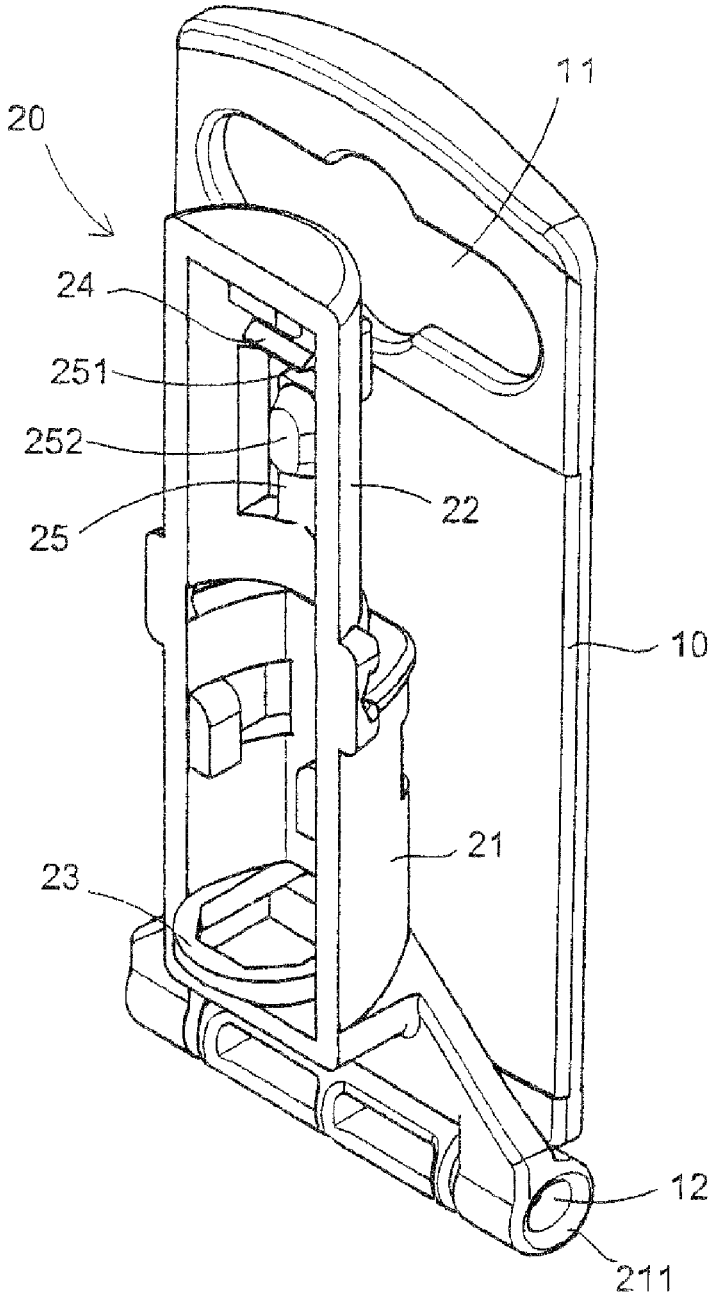
FIG. 1 is a perspective view showing a drill bit suspension structure according to the present invention in a collapsed condition.
Figure 2:
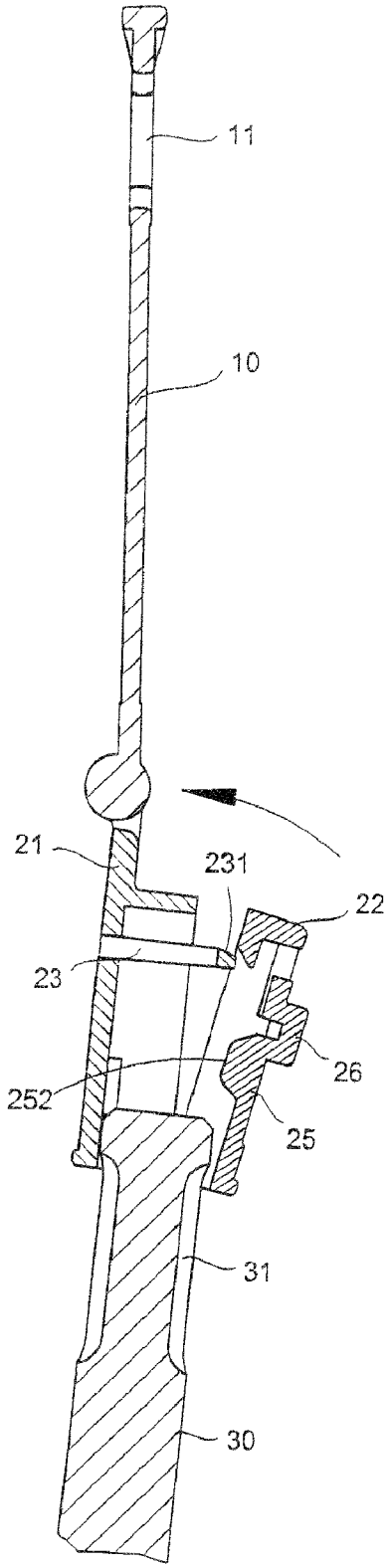
FIG. 2 is a cross-sectional view showing a drill bit set in a suspended package according to the present invention.
Figure 3:
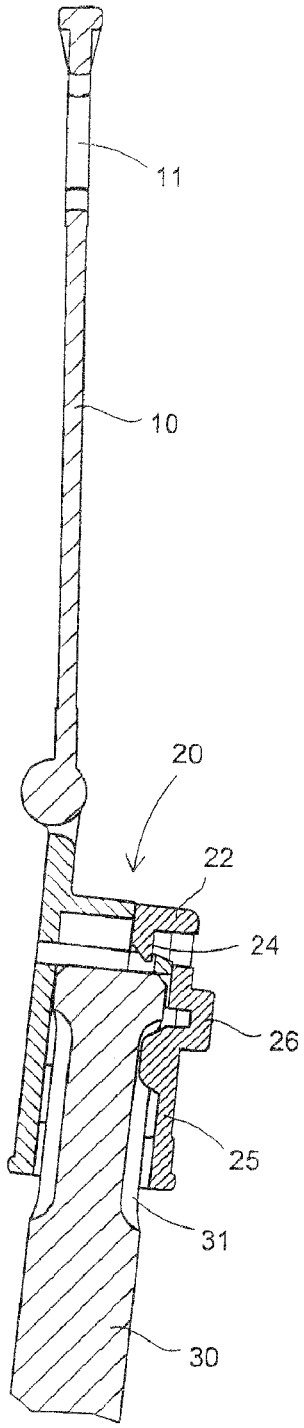
FIG. 3 is a cross-sectional view showing the suspension of a drill bit according to the present invention.
Figure 4:
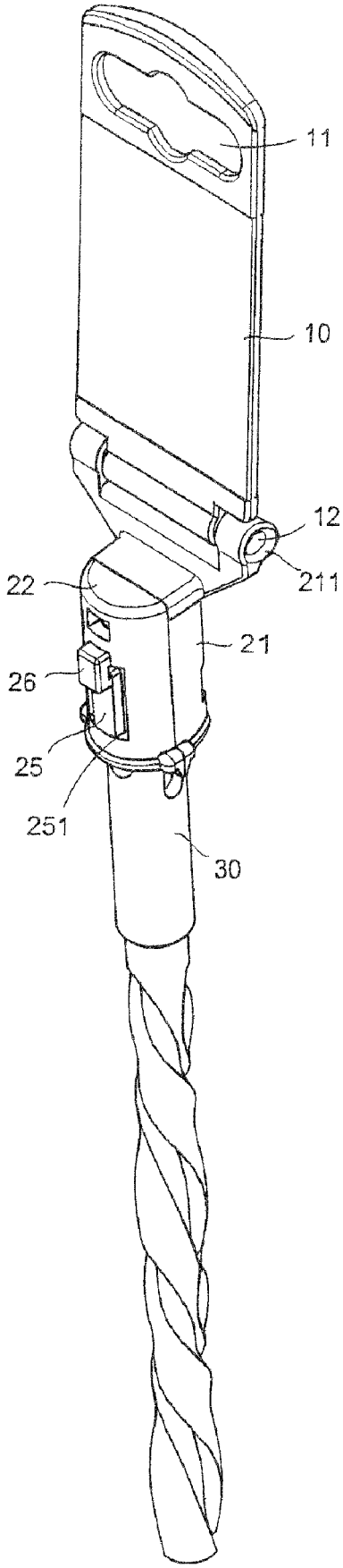
FIG. 4 is a perspective view showing the suspension of a drill bit according to the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The present invention provides a safety drill bit suspension structure. As shown in FIGS. 1-7, the drill bit suspension structure according to the present invention comprises a structural improvement that comprises a suspension board 10, serving as a main body for suspension, which is made in the form of an elongate plate, of which an outside contour or shape can be made in the form of for example a figure of an animal or any desired curved configuration for the sake of aesthetics. The board has a central portion, which forms, in an upper part thereof an elongate hole 11 for suspension and also has a bottom edge that forms, in opposite side portions thereof, pivot pins 12 or pivot slots for pivotal connection purposes. A carrier seat 20 is provided for receiving the insertion of and positioning a drill bit 30 and has a top edge that is structured to form a pivotal connection of pin or slot mating the pivotal connection of the suspension board. The carrier seat 20 is composed of two tubular trough halves, which are respective a base 21 and a cover 22 mateable with each other to form a complete structure of the carrier seat 20 for insertion and suspension of tool. The base 21 has a top edge forming pivot collars 211 for rotatable and receiving engagement with the pivot pin 12 of the suspension board 10. This allows the suspension board 10 to be folded and thus positioned against an outer side of a suspended tool 30. To facilitate stable and film positioning between the two members, additional means for securing may be provided for realizing secured positioning after the folding. This is not a novel part of the present invention and will not be further described. The base 21 forms a projecting positioning ring 23 on an inside circumference thereof at a predetermined location. The positioning ring can project from the bottom or top of the trough of the base to define a positioning surface. The positioning ring forms an inclined lead-in face 231 projecting from a front edge thereof in the form of inclining from an inner circumferential surface of the ring toward an outer circumferential surface. The base 21 is connected, at the bottom edge thereof, to the cover 22, which is in the form of a mateable half configuration and shows a tubular trough like structure. The cover 22 forms, at a top edge thereof at a location corresponding to the positioning ring 23, a barbed locking plate 24 so that when the cover 22 is turned over for mutual engagement with the base 21, they can be fixed to each other. Further, the cover 22 has a tubular circumferential outside surface, which forms, in a central portion thereof, an opening 251 in order to define a resiliently deflectable retention tab 25 that is located in the opening. The tab forms a flange 252 on an inside surface thereof adjacent to a top end to serve as inward projecting positioning device. On the outside circumferential surface of the cover, a connection element 26, which is in the form of a slender strip, is provided by the opening to connect between outside surfaces of the retention tab 25 and the cover 22 to maintain the retention tab 25 in a fixed and connected configuration that prevents the tab from resilient deflection so as to ensure firm and secure insertion of a drill bit 30 therein without undesired detachment and falling when the base and the cover are coupled to each other to form a tubular carrier seat 20.

To use the suspension structure, based on the drill bit 30 to be suspended, the cover 22 is turned upward by a proper angle to have a surface of the lower portion thereof that is in pivotal connection with the base 21 forming an insertion opening for receiving the entry of the drill bit 30 into the interior of the carrier seat 20. The tool 30 is inserted so that a top end thereof is set in contact engagement with an underside of the positioning ring 23 to be thereby positioned by the ring and a positioning cavity 31 that is formed by being recessed in the drill bit 30 to be oriented to correspond to the retention tab 25, whereby when the cover 22 is rotated to mate and couple to the base, the flange 252 of the retention tab 25 is received into the positioning cavity 31 of the drill bit 30. The locking plate 25 formed on the top end of the inside circumference of the cover 22 is guided by the inclined lead-in face 231 formed on the positioning ring 23 to get into retaining engagement with the inner circumference of the positioning ring 23 for locking and positioning and ensuring secured suspension of the drill bit 30 received into the carrier seat 20. It is apparent that the spatial arrangement of the base 21 and the cover 22 is not limited to the embodiment described above. For example, the configuration of the base can be made for sideway connection, and the mutual locking arrangement is neither limited to the retaining engagement realized through the positioning ring 23 and instead, locking means may be provided at side portions. The pivotal connection formed on the bottom of the suspension board 10 allow the drill bit 30 to be properly suspended through the gravity thereof to ensure vertical suspension of the suspension board 10 for suspended exhibition, achieving advantages of both aesthetic suspension and theft-resistant security.

Figure 5:
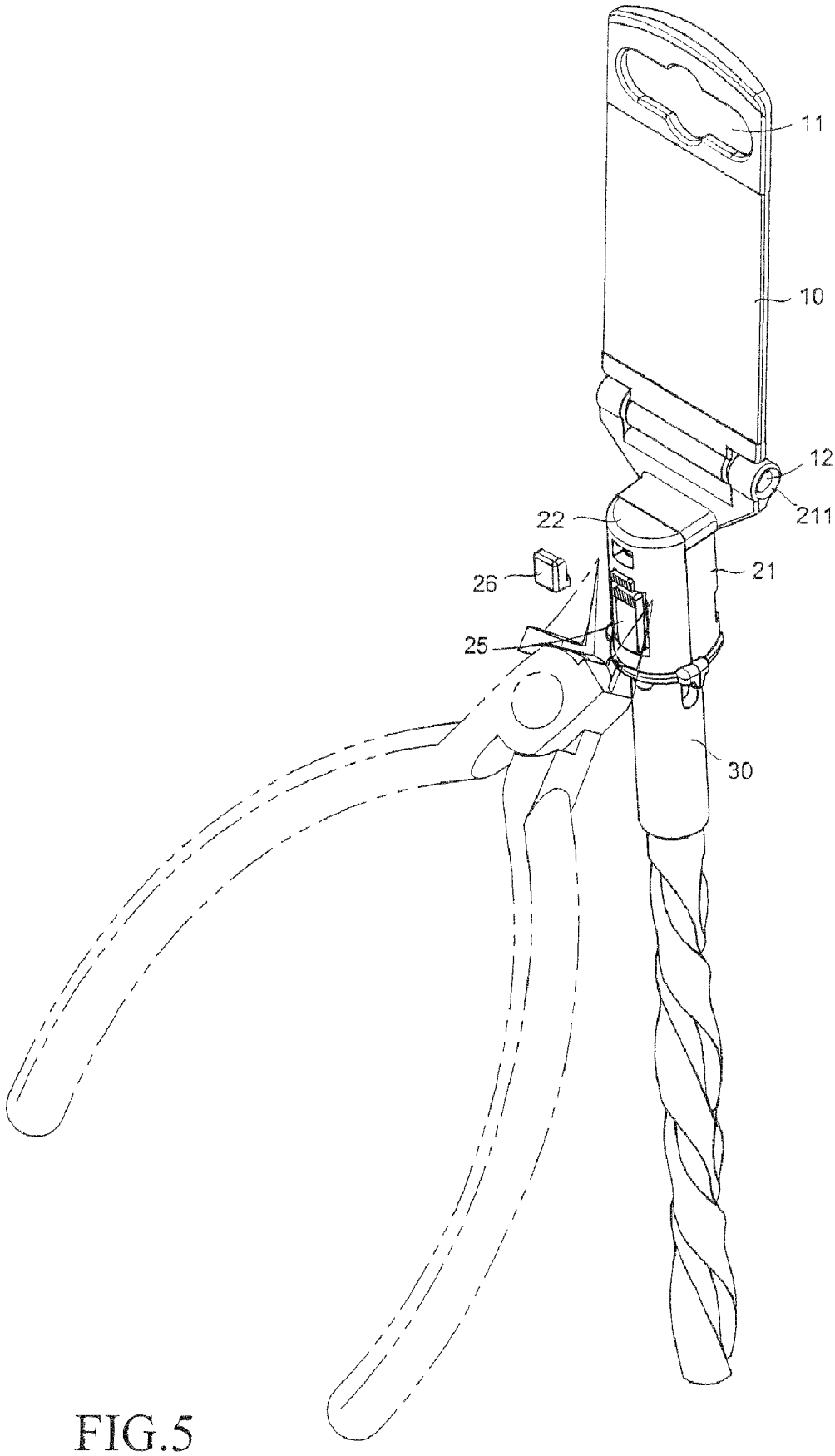
FIG. 5 is a perspective view showing the use of a tool to cut off a connection element for removal of the drill bit.
Figure 7:
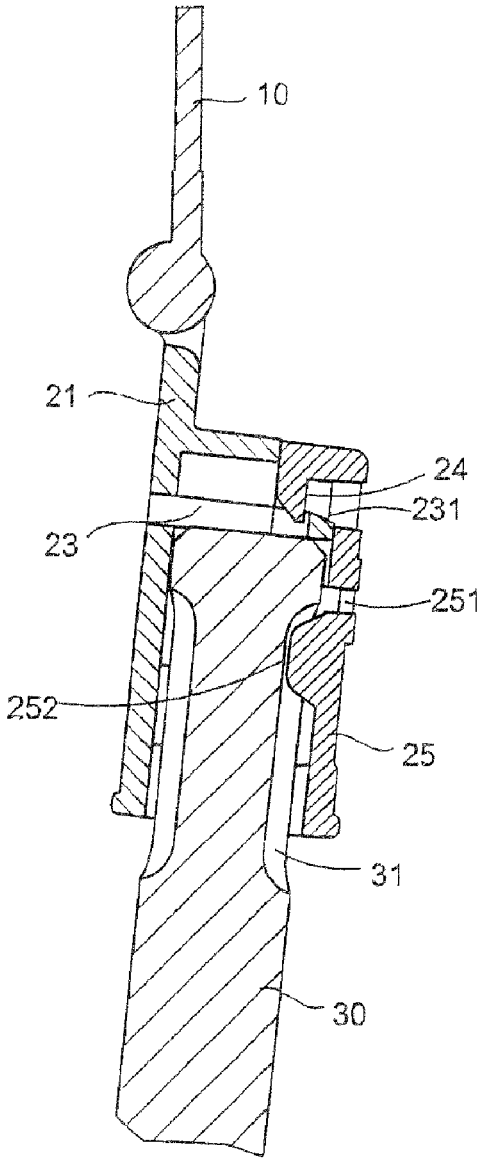
FIG. 7 is a cross-sectional view showing the suspension of the drill bit after the theft-resistant means is cut off.
Figure 6:
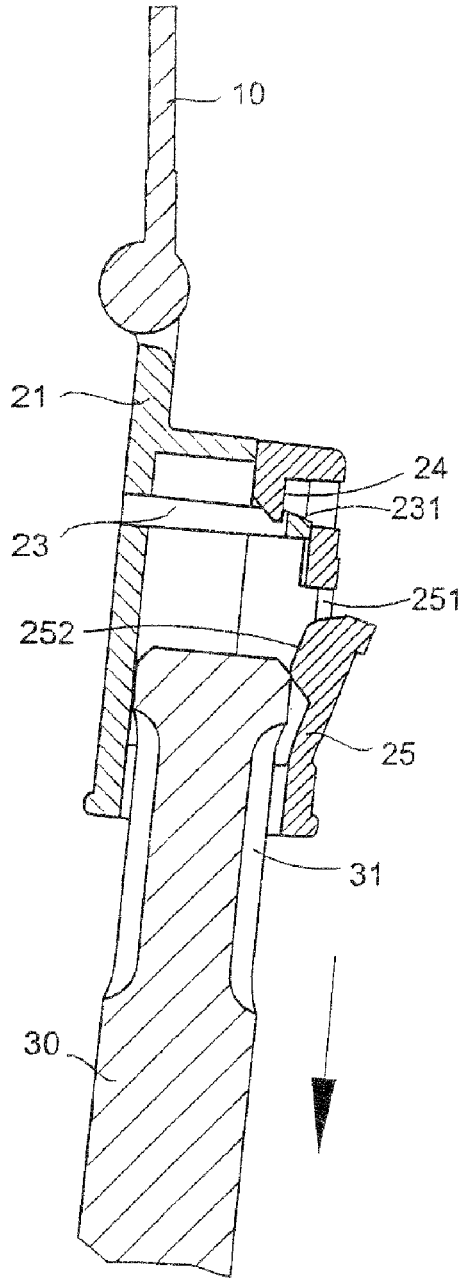
FIG. 6 is a cross-sectional view showing the removal of the drill bit after cutting off theft-resistant means.

A user may use a tool, such as scissors, to cut off the connection element 26 that is provided on the outside surface of the cover 22 to connect and fix the retention tab 25, as shown in FIG. 5. With the retention tab 25 being formed inside the surrounding opening 251, the tab is made resiliently deflectable, whereby an exhibited drill bit 30 can be forcibly pulled out for removal as shown in FIGS. 6 and 7, to facilitate easy access and use. The suspension structure according to the present invention provides resilient deflection of the retention tab 25, whereby after the use of the drill bit 30 that has been removed from the suspension structure, the drill bit 30 can be positioned under the bottom of the carrier seat 20 to be in alignment with the insertion opening of the carrier seat for insertion, and at the same time, rotation of the drill bit 30 is made to have the positioning cavity 31 corresponding to the retention tab 25 to proceed with the insertion, whereby the retention tab 25 is forced to resiliently deflect outward to allow the flange 252 to move the top end portion of the bit to reach the positioning cavity 31 and thus resiliently set into retaining engagement with the positioning cavity 31. Thus, retaining engagement is re-built. This allows the drill bit 30 to be stored in a suspended condition. The suspension structure provides an advantage of theft resistance in exhibition for sale and also provides an advantage of repeated suspension for storage after the use of the too. In view of the construction of the suspension structure, the suspension structure can be completely made by means of plastic molding, so that the suspension board 10 and pivotally connected base 21 and cover 22 are molded together as a connected arrangement to make the manufacture easy. Such a structure is an innovate one compared to those existing in the market and provides an advantage of suspension security that is a practical innovation of the suspension device of this kind.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A safety drill bit suspension structure, comprising a suspension board and a carrier seat that receives insertion of a tool, characterized in that the suspension board and the carrier seat are pivotally connected to each other, the carrier seat comprising mateable halves of tubular trough that respectively define a base and a cover, wherein the base has a top end forming therein a positioning ring for positioning of a tool inserted therein and a bottom end connected to the cover, the cover having a circumferential surface forming in a central portion thereof an opening that surrounds a retention tab, the tab having a top end forming a flange projecting in a direction of an inner circumference of the cover, the tab having an outer circumferential surface that is connected and fixed to the opening by a connection element to form a theft resistant device, the cover forming a locking member at a top end thereof and projecting from a location corresponding to the positioning ring so that when the cover and the base mate and couple to each other, the locking member is put into engagement with an inner circumference of the positioning ring to form a complete structure of the carrier seat, whereby the drill bit is inserted through the insertion opening of the carrier seat in an upward direction to get into contact with the positioning ring before the carrier seat is completely coupled, and the tool has a surface forming a recessed positioning cavity that receives the retention tab to engage therein so as to achieve the purpose of use for safety suspended exhibition.

2. The safety drill bit suspension structure as claimed in claim 1, wherein the connection between the base and the cover is arranged at a middle section or a side portion for mutual connection.

3. The safety drill bit suspension structure as claimed in claim 1, wherein the base has a top end forming a pivot collar that forms a pivotal connection with a pivot pin of the suspension board.

4. The safety drill bit suspension structure as claimed in claim 1, wherein the suspension board forms an elongate hole in an upper portion thereof for suspension.

5. The safety drill bit suspension structure as claimed in claim 1, wherein the positioning ring has an edge opposing the locking member, the edge forming an inclined lead-in face.

6. The safety drill bit suspension structure as claimed in claim 1, wherein the positioning ring is not limited to being arranged on the bottom of the trough of the base or extending from a top location.

7. The safety drill bit suspension structure as claimed in claim 1, wherein coupling between the cover and the base is not limited to the coupling realized by the positioning ring and the locking member.

* * * * *